US012735890B2

(12) United States Patent
Bogart et al.

(10) Patent No.: US 12,735,890 B2
(45) Date of Patent: Sep. 15, 2026

(54) SYSTEM AND METHOD FOR A MODULAR CEILING GRID BEAM THAT SUPPORTS CONSTRUCTION OF A CONTROLLED ENVIRONMENT OR CATWALK

(71) Applicant: AIRTHO, Durham, NH (US)

(72) Inventors: Brandon Bogart, Danville, NH (US); Olivia Leray, Manchester, NH (US); Nick Wheeler, Madbury, NH (US)

(73) Assignee: AIRTHO, Durham, NH (US)

( * ) Notice: Subject to any disclaimer, the term of this patent is extended or adjusted under 35 U.S.C. 154(b) by 159 days.

(21) Appl. No.: 18/639,576

(22) Filed: Apr. 18, 2024

(65) Prior Publication Data

US 2024/0352731 A1 Oct. 24, 2024

Related U.S. Application Data

(60) Provisional application No. 63/460,213, filed on Apr. 18, 2023.

(51) Int. Cl.
*E04B 9/10* (2006.01)

(52) U.S. Cl.
CPC ..... *E04B 9/10* (2013.01)

(58) Field of Classification Search
CPC ..... E04B 9/00; E04B 9/10
See application file for complete search history.

(56) References Cited

U.S. PATENT DOCUMENTS

| | | | | |
|---|---|---|---|---|
| 6,079,174 | A * | 6/2000 | Williams | E04B 2/827 52/693 |
| 9,057,201 | B2 * | 6/2015 | Milligan | E06B 3/54 |
| 10,697,170 | B1 * | 6/2020 | Mazzola Vernengo | E04F 11/1804 |
| 11,428,015 | B2 * | 8/2022 | Huss | B62B 3/008 |
| 11,788,283 | B2 * | 10/2023 | Lee | E04B 2/7453 52/126.4 |
| 2010/0242378 | A1 * | 9/2010 | Cifelli | E04B 2/821 52/126.6 |
| 2022/0064965 | A1 * | 3/2022 | Huss | E04B 1/34315 |
| 2023/0332403 | A1 * | 10/2023 | Frame | E04B 9/10 |
| 2024/0263471 | A1 * | 8/2024 | Rogers | E04H 3/24 |

* cited by examiner

*Primary Examiner* — Chi Q Nguyen
(74) *Attorney, Agent, or Firm* — Hayes Soloway P.C.

(57) ABSTRACT

A ceiling grid beam assembly includes a top section and a bottom section, which may have the same profile as the top section. The top section and the bottom section each include at least four plate channels. The plate channels provide for the installation of plates between an adjoining top section and bottom section, between two adjoining top sections, or between two adjoining bottom sections. A top section or a bottom section may be engaged with 2-3 plates. The same ceiling grid beam assembly can be used to make a support structure for controlled environment insulated panels or a catwalk.

20 Claims, 13 Drawing Sheets

SYSTEM AND METHOD FOR A MODULAR CEILING GRID BEAM THAT SUPPORTS CONSTRUCTION OF A CONTROLLED ENVIRONMENT OR CATWALK

CROSS-REFERENCE TO RELATED APPLICATIONS AND PRIORITY

This patent application claims priority from U.S. Provisional Patent Application No. 63/460,213 filed Apr. 18, 2023. This patent application is herein incorporated by reference in its entirety.

FIELD

The disclosure is directed to components for the construction of a controlled environment or a catwalk.

BACKGROUND

A controlled environment within a building is often used for medical or scientific purposes. The space may need to be controlled to prevent intrusion of airborne particles, control temperature, control pressure, or similar needs dependent upon the exact use of the space. Controlled environments may include cleanrooms, dry rooms, refrigeration rooms, etc. Constructing these spaces requires integrated ceilings, floors, and walls that allow controlled passage of air, but otherwise seals the space. Materials that form the space must cooperate with little tolerance for deviation.

The construction requirements for a controlled environment are more easily achieved in new construction as compared to retrofitting an existing space. An existing space in a warehouse, for example, may have a series of columns within the space. Maximizing use of the space requires tightly fitting materials to the existing structures without compromising control of the controlled environment space.

FIG. 1 is an illustration of a perspective view of elements of a warehouse for installation of a controlled environment hung ceiling. The illustration includes a girder 12, a column 14, a first face 14A of the column 14, a second face 14B of the column 14, a metal channel 16, a threaded rod 18, a connector 20, and a ceiling grid beam 22. The girder 12 and column 14 are pre-existing parts of the warehouse. The hung ceiling may further be composed of insulated metal panels (IMPs), structural insulated panels (SIPs), or comparable panels, all of which are hereinafter identified as insulated panels. To suspend insulated metal panels horizontally, it would be known in the art to fix a metal channel 16 to the girder 12, attach a threaded rod 18 in a vertical position from the metal channel 16, and use a connector 20 to attach the threaded rod 18 to the ceiling grid beam 22. As can be seen in FIG. 1, the ceiling grid beam 22 abuts a first face 14A of the column 14.

FIG. 2 is an illustration of a front elevational view of a portion of the elements of the warehouse for installation of a controlled environment hung ceiling as illustrated in FIG. 1. The ceiling grid beam 22 is attached by a connector 20 to the threaded rod 18. The profile of the ceiling grid beam 22 is extruded with specific known dimensions to closely fit other commonly utilized controlled environment construction elements. In the background, the profile of the column 14 is visible with a second surface 14B positioned beyond a perimeter of the ceiling grid beam 22. As a result, when attempting to install an insulated panel 24, it is understood that the column 14 obstructs insulated panel installation and requires fitment of panels at the column. Requiring field modification of parts is undesirable as it invites flaws in the controlled environment construction that result in diminished control of the space.

Thus, it is a goal to design controlled environment installation elements that can cooperate to allow controlled environment construction with reduced or eliminated field alteration of the controlled environment installation elements.

SUMMARY

The subject matter of this application may involve, in some cases, interrelated products, alternative solutions to a particular problem, and/or a plurality of different uses of a single system or article. Two of which are 1) a support structure for controlled environment insulated panels, and 2) a catwalk. Advantageously, both can utilize the same top section or bottom section and panels of a ceiling grid beam assembly.

One example embodiment provides a controlled environment insulated panel support structure having a ceiling grid beam that includes a top section and a bottom section, which may have the same profile as the top section. The top section and the bottom section each include at least four plate channels. The plate channels provide for the installation of plates between an adjoining top section and bottom section, between two adjoining top sections, or between two adjoining bottom sections. A top section or a bottom section may be engaged with 2-3 plates.

The subject matter of this application also encompasses a method of assembling a controlled environment ceiling framing apparatus. The method includes extruding a top section having a plurality of plate channels. A bottom section having a plurality of plate channels is extruded. A plurality of plates are formed. Each plate of the plurality of plates is snugly fit into at least one plate channel of the plurality of plate channels and fixing the plate in place. At least one plate of the plurality of plates is snugly fit into one plate channel of the plurality of plate channels of the top section and into one plate channel of the plurality of plate channels of the bottom section. Fixing the plate in each location attaches the top section to the bottom section.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the inventive subject matter.

Figure 1:
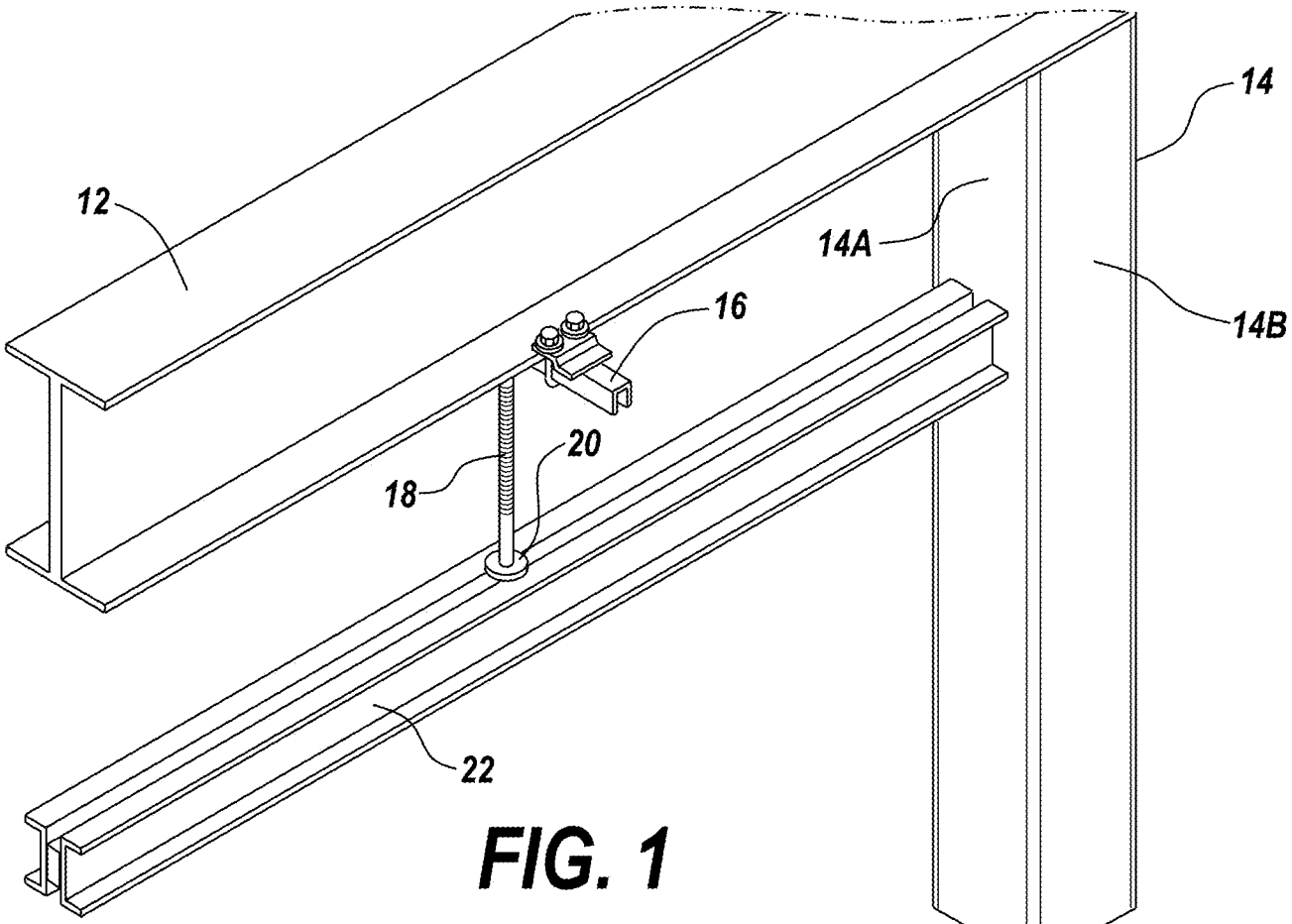
FIG. 1 PRIOR ART
FIG. 1 is an illustration of a perspective view of elements of a warehouse for installation of a controlled environment hung ceiling, as is known in the prior art.

These and other features of the present embodiments will be understood better by reading the following detailed description, taken together with the figures herein described. In the drawings, each identical or nearly identical component that is illustrated in various figures may be represented by a like numeral. For purposes of clarity, not every component may be labeled in every drawing. Furthermore, as will be appreciated in light of this disclosure, the accompanying drawings are not intended to be drawn to scale or to limit the described embodiments to the specific configurations shown.

DETAILED DESCRIPTION

Figure 3:
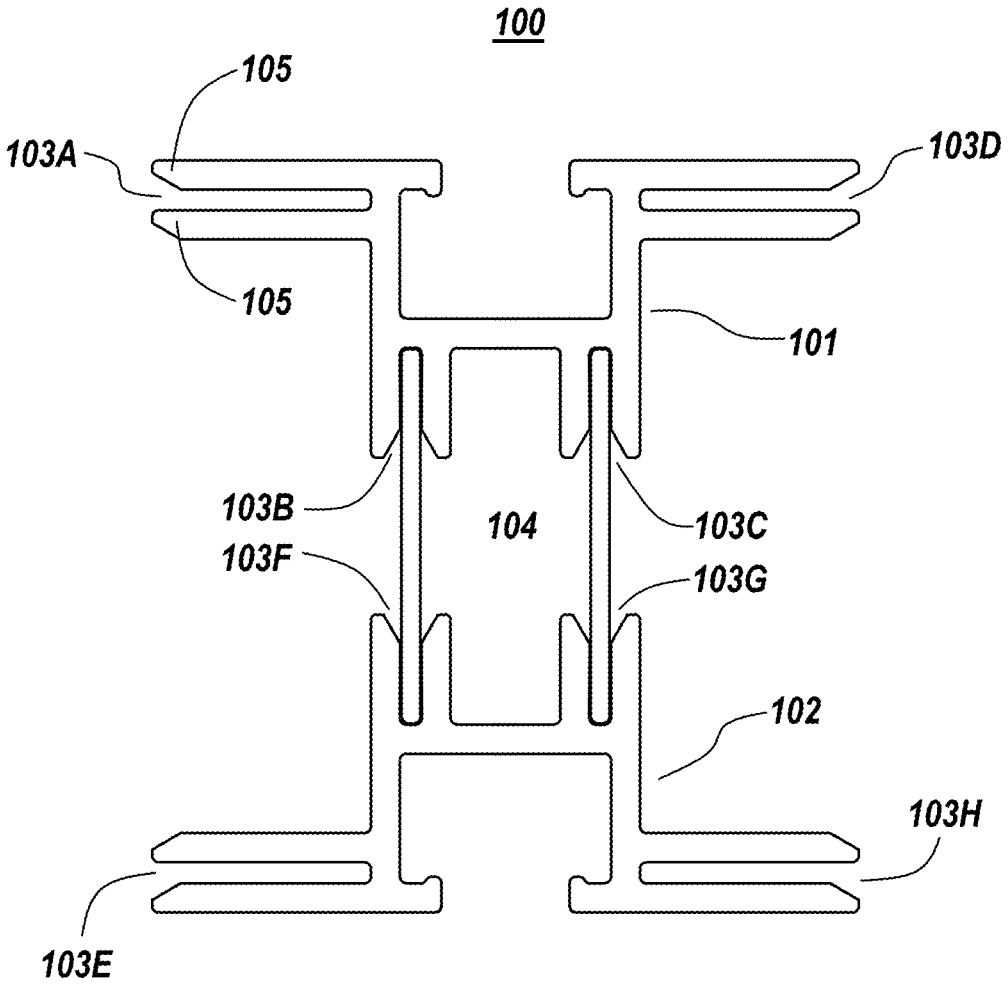
FIG. 3 is an illustration of a front elevational view of a proposed ceiling grid beam, in accordance with the first exemplary embodiment of the present disclosure.

FIG. 3 is an illustration of a front elevational view of a proposed ceiling grid beam 100. The ceiling grid beam 100 includes a top section 101 and a bottom section 102, which may have the same profile as the top section 101. The top section 101 and the bottom section 102 each include at least four plate channels 103A-H. The plate channels 103A-H provide for the installation of plates 104 between an adjoining top section 101 and bottom section 102, between two adjoining top sections 101, or between two adjoining bottom sections 102. A top section 101 or a bottom section 102 may be engaged with 2-3 plates.

The width of the plate channels 103A-H is equivalent to the thickness of the plates 104. Plates 104 should fit snugly into the plate channels 103A-H to minimize if not prevent passage of air through the connection if the interior space is designed to have a controlled environment. Plates 104 may be fixed to the plate channels 103A-H by adhesives or mechanical fasteners or any other means as may be known to those having ordinary skill in the art. An epoxy or compound may be inserted into plate channels 103A-H to further suppress passage of air through these connections. Plates 104 may be attached to the plate channels 103A-H during factory construction and not in the field to manage tolerances of the controlled environment construction elements. Plate channel ends 105 may be beveled to ease insertion of the plates 104. Plate channel ends 105 may also be beveled to ease insertion of the insulated panel 24 (illustrated in FIG. 5).

Figure 4:
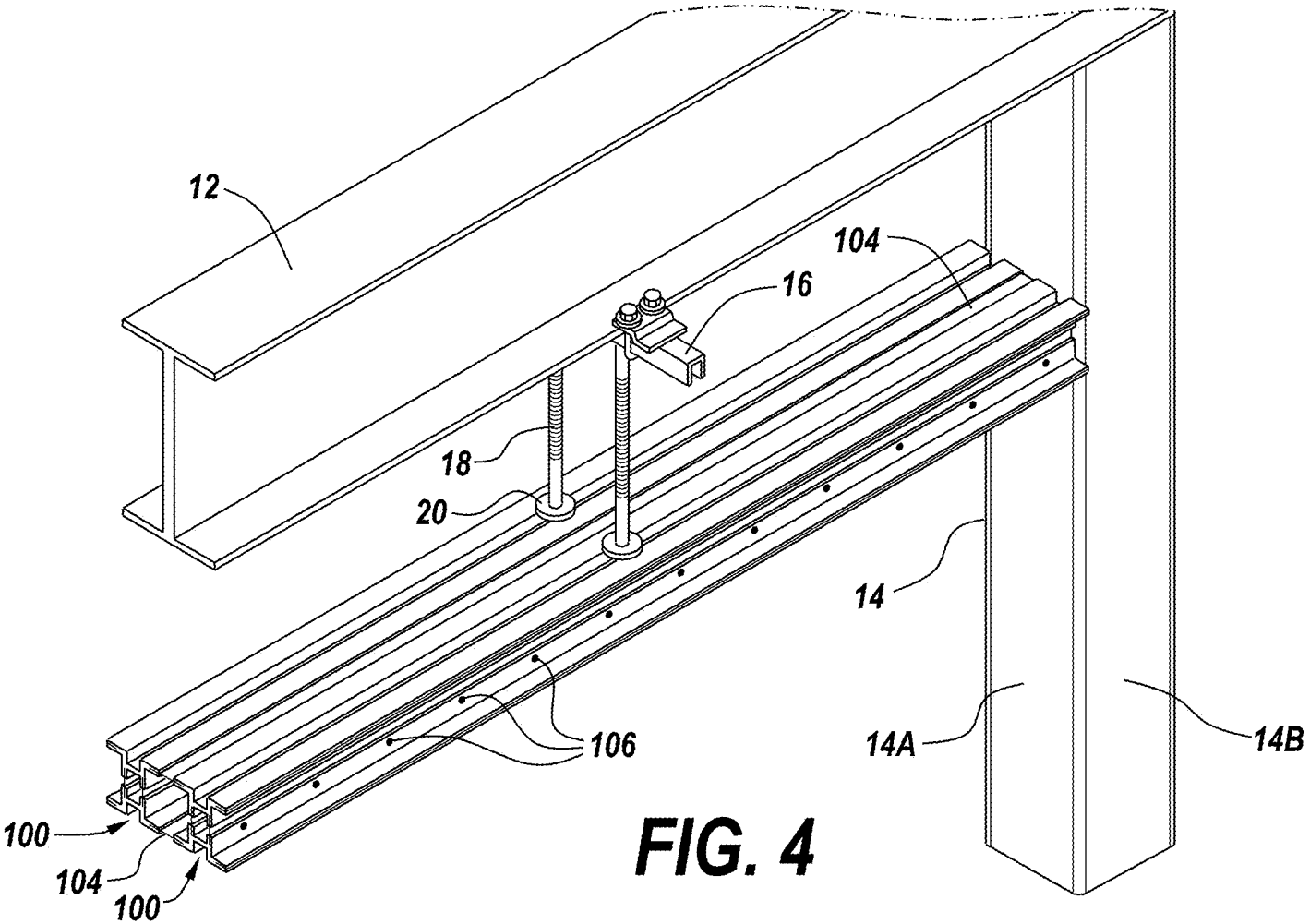
FIG. 4 is an illustration of a perspective view of elements of a warehouse for installation of a controlled environment hung ceiling, in accordance with a first exemplary embodiment of the present disclosure.

FIG. 4 is an illustration of a perspective view of elements of a warehouse for installation of a controlled environment hung ceiling, in accordance with a first exemplary embodiment of the present disclosure. The girder 12 and column 14, including a first face 14A and a second face 14B, mirror the same elements illustrated in the FIG. 1 prior art drawing. The metal channel 16 is fixed to the girder 12. Two threaded rods 18 are connected to the metal channel 16 by means known to those having ordinary skill in the art. The threaded rods 18 are connected by connectors 20 to two ceiling grid beams 100. The ceiling grid beams 100 abut the first face 14A of the column 14.

Each ceiling grid beam 100 includes a top section 101 and a bottom section 102. The top section 101 and the bottom section 102 each include at least four plate channels 103A-H (not labeled). The plate channels 103A-H provide for the installation of plates 104 between the adjoining top sections 101 and bottom sections 102, between two adjoining top sections 101, and between two adjoining bottom sections 102. Each of the top sections 101 and each of the bottom sections 102 is engaged with three plates 104. A series of mechanical fasteners 106 pierce a bottom section 102 and engage with one of the plates 104. The view in FIG. 3 does not illustrate mechanical fasteners 106 in other locations, but one having ordinary skill in the art will understand how various known mechanical fasteners 106 could be used to attach each of the plates 104.

Figure 5:
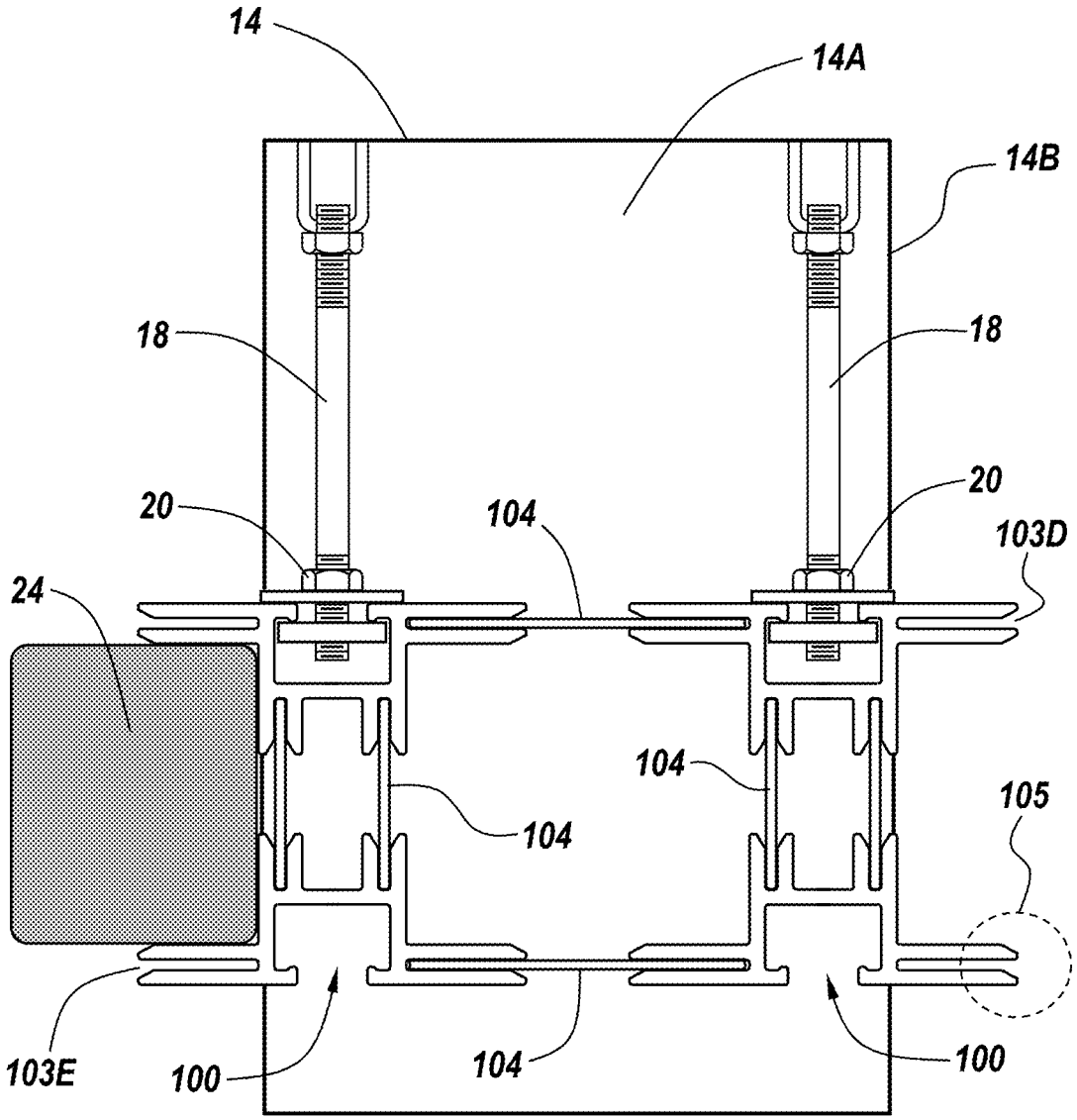
FIG. 5 is an illustration of a front elevational view of a portion of the elements of the warehouse for installation of a controlled environment hung ceiling as illustrated in FIG. 3, in accordance with a first exemplary embodiment of the present disclosure.

FIG. 5 is an illustration of a front elevational view of a portion of the elements of the warehouse for installation of a controlled environment hung ceiling as illustrated in FIG. 4, in accordance with a first exemplary embodiment of the present disclosure. Each ceiling grid beam 100 includes a top section 101 and a bottom section 102. The top section 101 and the bottom section 102 each include at least four plate channels 103A-H. The plate channels 103A-H provide for the installation of plates 104 between the adjoining top sections 101 and bottom sections 102, between two adjoining top sections 101, and between two adjoining bottom sections 102. Each of the top sections 101 and each of the bottom sections 102 is engaged with three plates 104.

Figure 2:
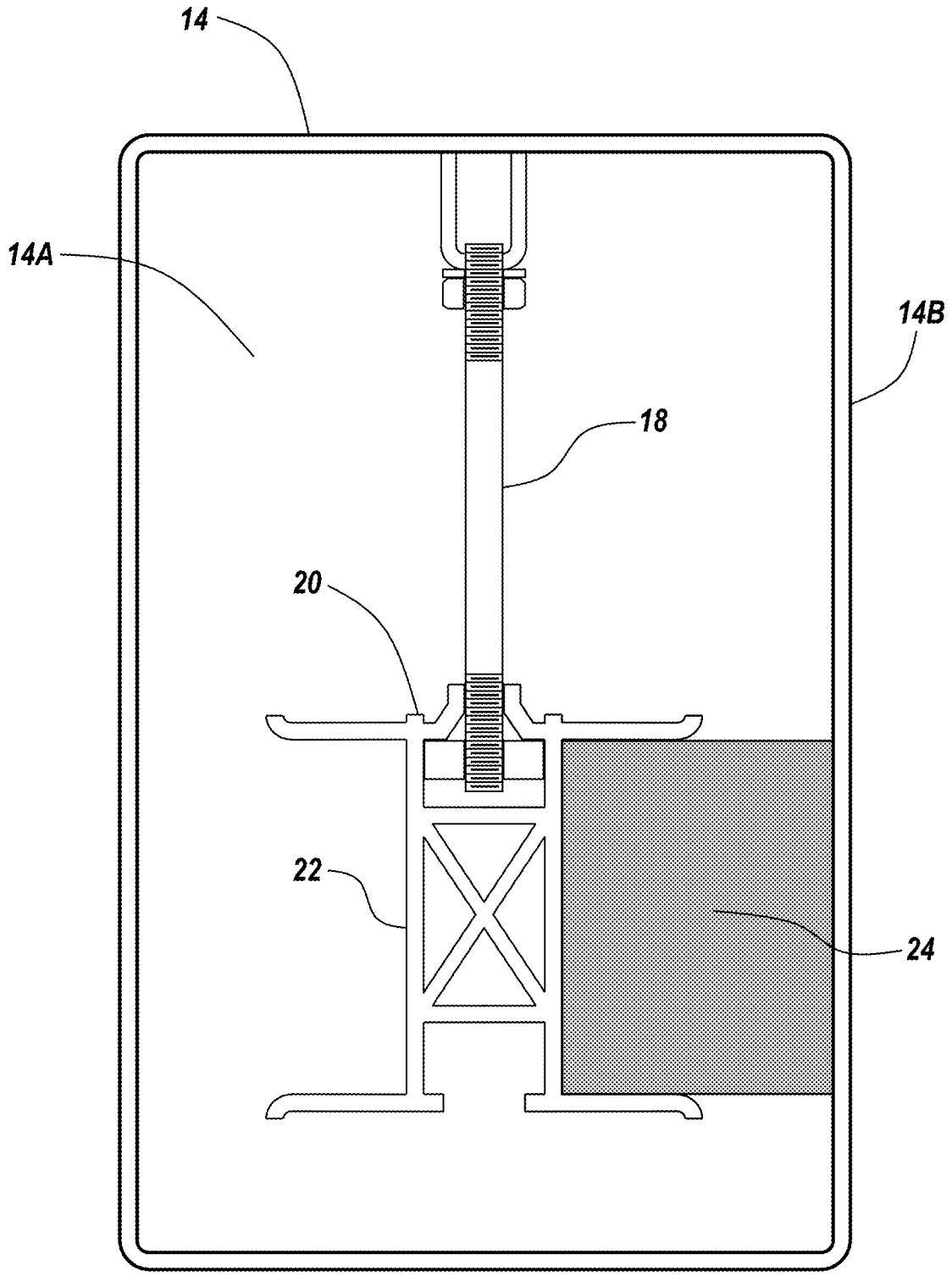
FIG. 2 PRIOR ART
FIG. 2 is an illustration of a front elevational view of a portion of the elements of the warehouse for installation of a controlled environment hung ceiling as illustrated in FIG. 1, as is known in the prior art.

In the background of FIG. 5 sits the column 14 and the relationship of the column 14 relative to the ceiling grid beams 100 can be compared to the prior art system in FIG. 2. Specifically, the second face 14B of the column 14 is coplanar with a surface of one of the top section 101 and the bottom section 102. This relationship allows an insulated panel 24 to be inserted into that space and abut interior surfaces of the top section 101 and the bottom section 102 and the second face 14B of the column 14, obviating the need to cut or reshape the insulated panel to fit the column 14. Placing two ceiling grid beams 100 in close proximity and joining the ceiling grid beams 100 with two plates 104 allows insulated panels 24 to be placed abutting the column 14 on the second face 14B and an opposite face of the column 14, which was not achievable with any previously known design.

Figure 6A:
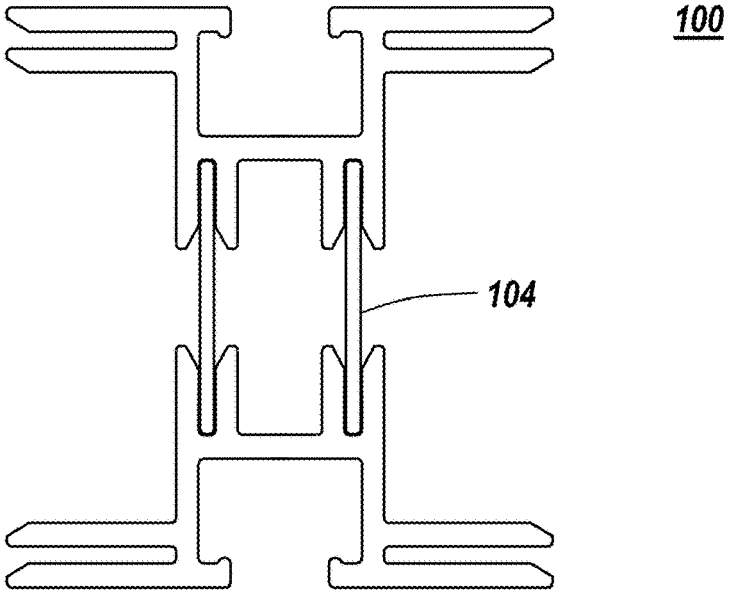
FIGS. 6A-6G illustrate front elevational views various dimensions that may be utilized for the adoption of the presently disclosed ceiling grid beam, each of which is part of the first exemplary embodiment of the present disclosure.
Figure 6B:
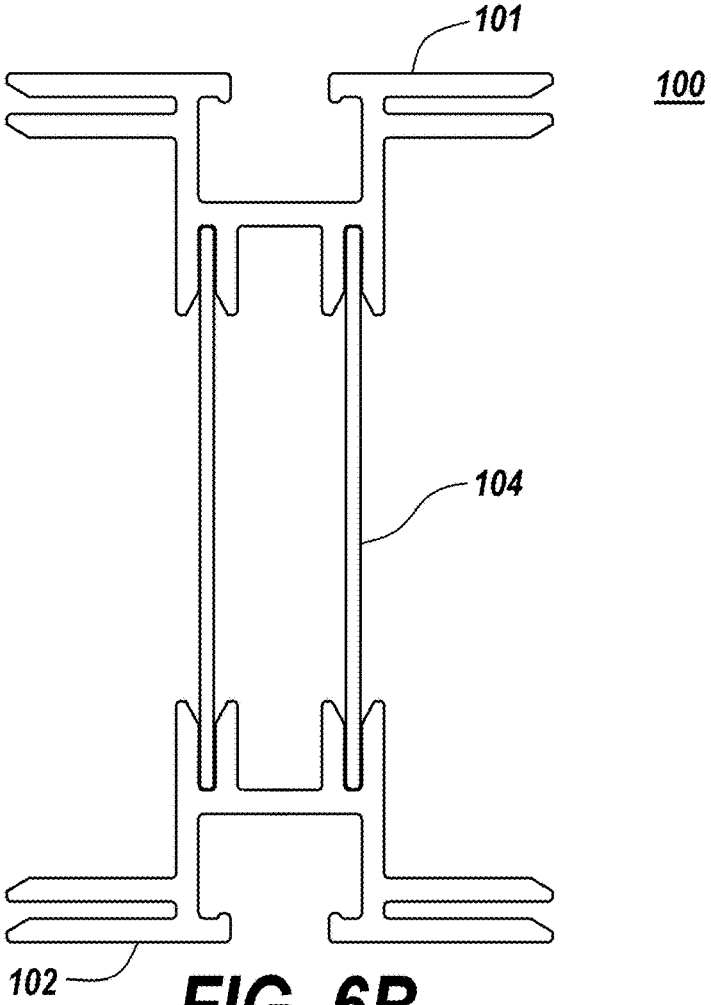
Figure 6C:
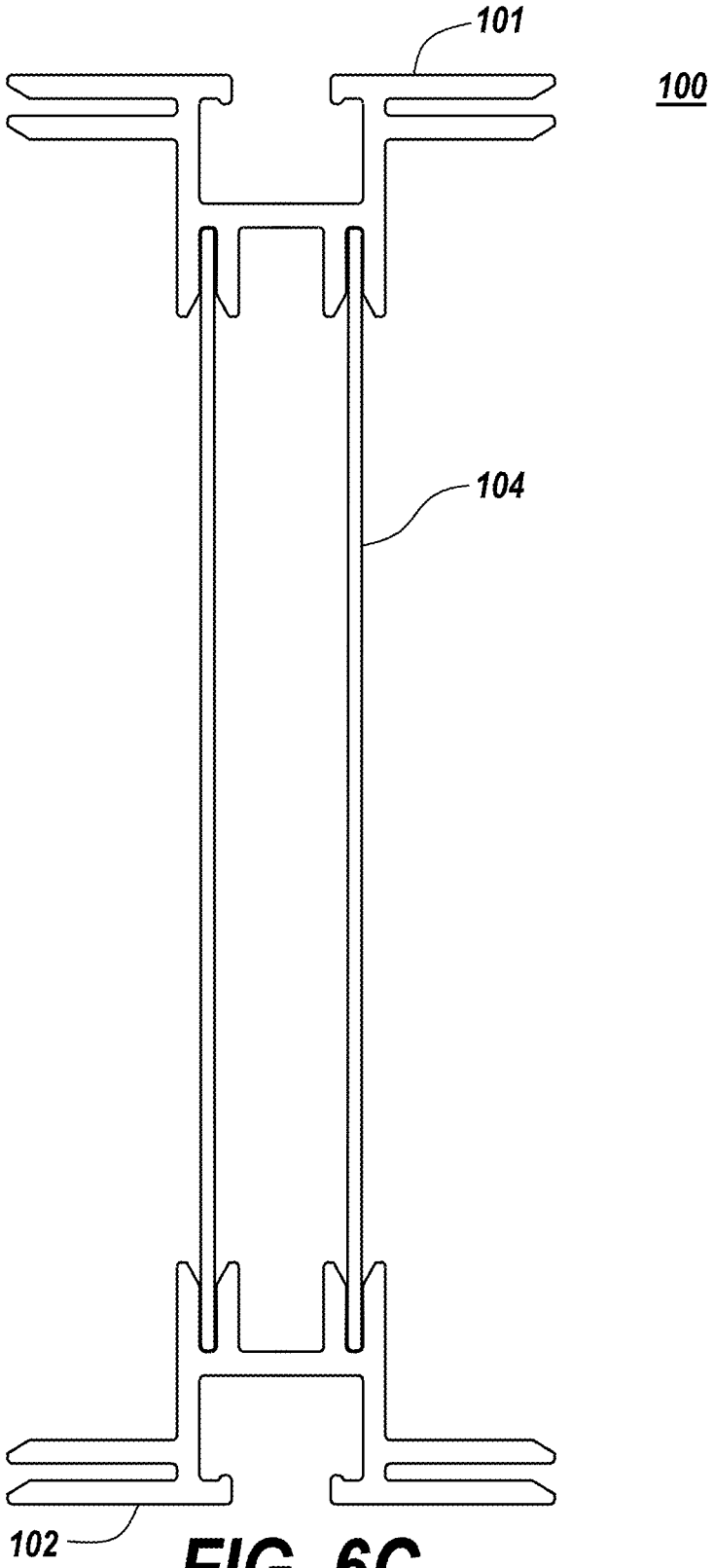

FIGS. 6A-6G illustrate front elevational views various dimensions that may be utilized for the adoption of the presently disclosed ceiling grid beam 100, each of which is part of the first exemplary embodiment of the present disclosure. FIGS. 6A-6C illustrate the ceiling grid beam 100 with different size plates 104 connecting the top section 101 and the bottom section 102. The different size plates 104 allow the same manufactured top section 101 and bottom section 102 to be used with insulated panels 24 (illustrated in FIG. 5) of varying depths. Being able to manufacture the same piece to serve as the top sections 101 and bottom sections 102 rather than manufacturing pieces with different profiles reduces manufacturing costs.

Figure 6D:
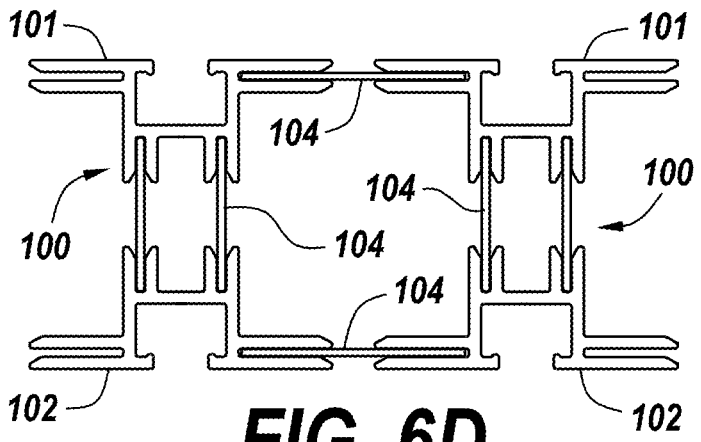
Figure 6E:
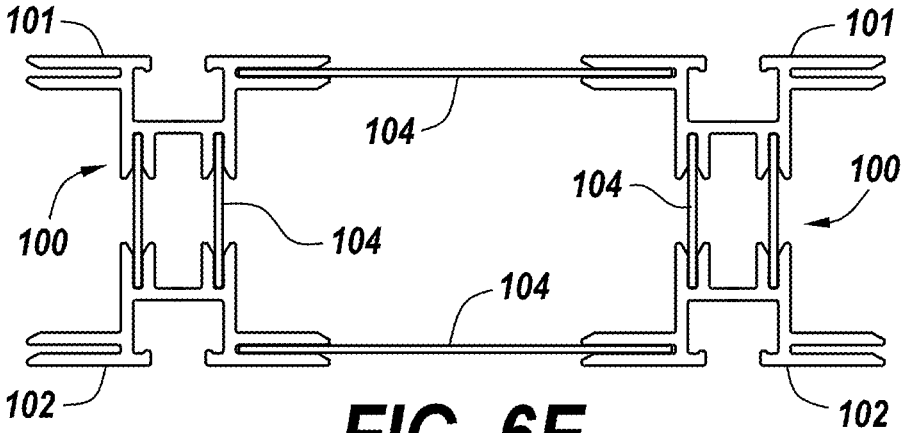
Figure 6F:
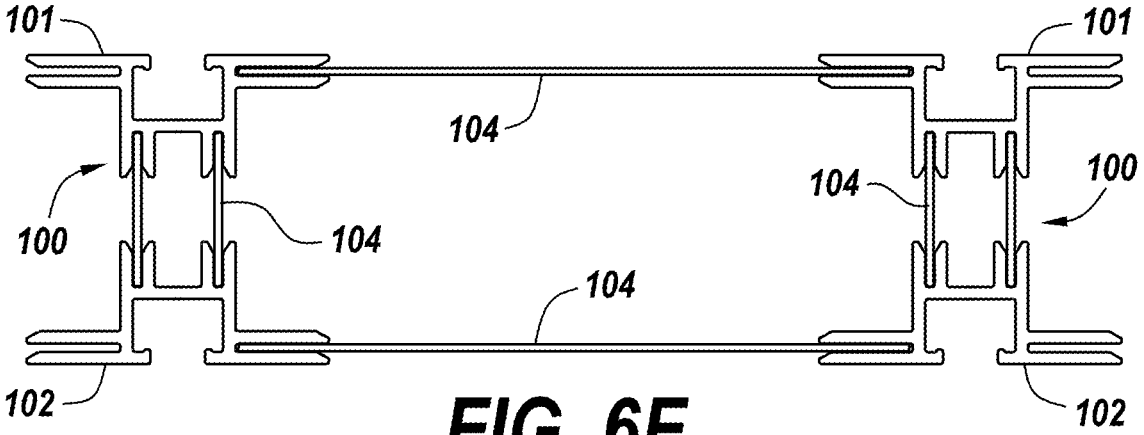

FIGS. 6D-6F illustrate the ceiling grid beam 100 with different size plates 104 connecting adjoining top sections 101 and adjoining bottom sections 102. The different size plates 104 allow the same manufactured top section 101 and bottom section 102 to be used with columns 14 (illustrated in FIG. 5) of varying widths. Being able to manufacture the same top sections 101 and bottom sections 102 for different applications reduces manufacturing costs.

Figure 6G:
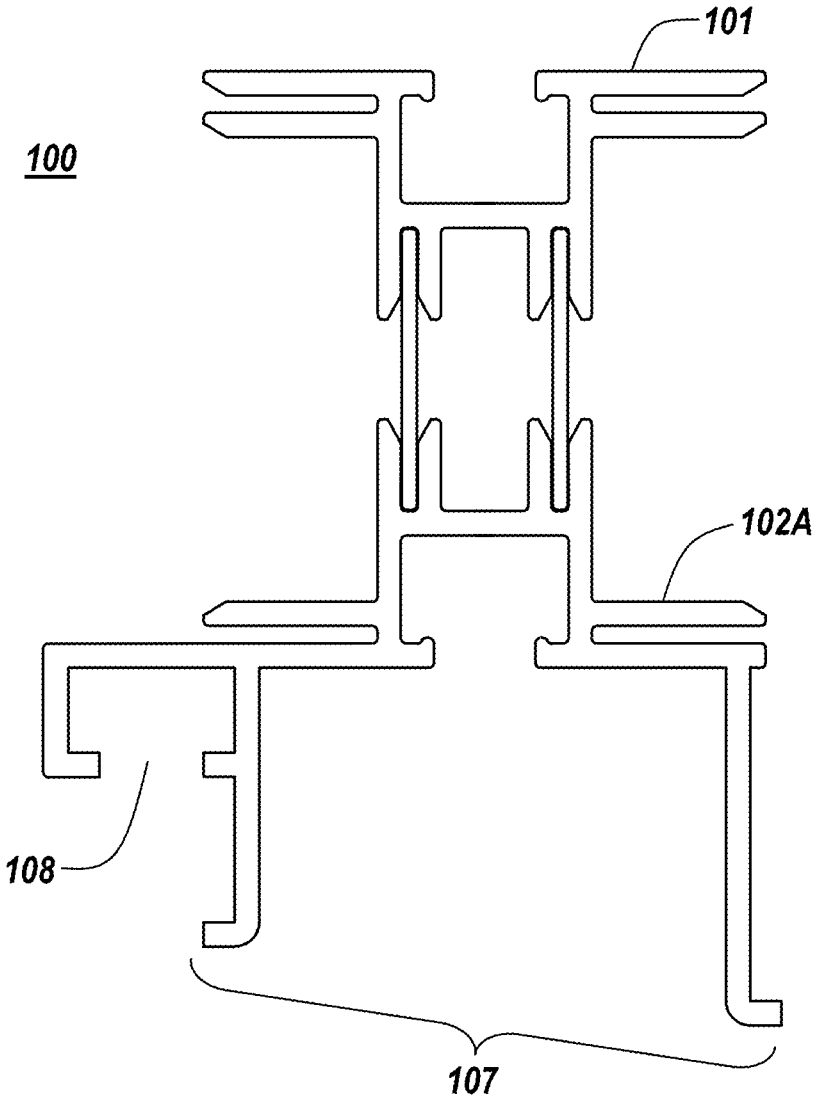

FIG. 6G illustrates the ceiling grid beam 100 with a modified bottom section 102A. The modified bottom section 102A includes a vertical panel channel 107 and a C-channel 108. It is known in the art to use variations on the prior art ceiling grid beam 22 to support construction elements beneath the prior art ceiling grid beam 22. Those same variations can be built into the bottom section 102A of the ceiling grid beam 100 without departing from the scope of the present disclosure.

Figure 7:
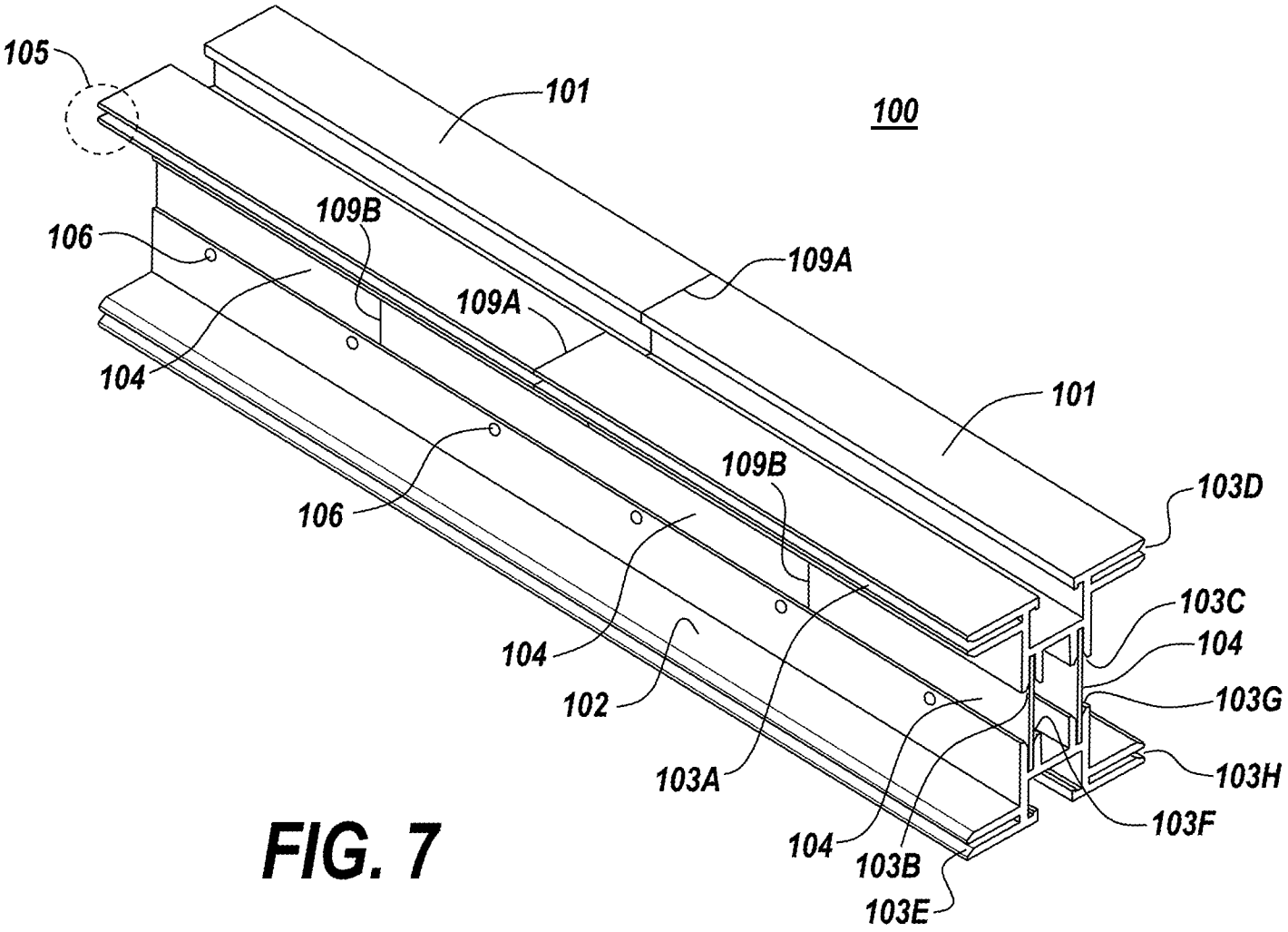
FIG. 7 is an illustration of a perspective view of more than one ceiling grid beam joined end to end, in accordance with a first exemplary embodiment of the present disclosure.

FIG. 7 is a perspective view of more than one ceiling grid beam 100 joined end to end, in accordance with a first exemplary embodiment of the present disclosure. The ceiling grid beam 100 includes a top section 101 and a bottom section 102. The top section 101 and the bottom section 102 each include at least four plate channels 103A-H. The plate channels 103A-H provide for the installation of plates 104 between the adjoining top sections 101 and bottom sections 102, between two adjoining top sections 101, and between two adjoining bottom sections 102. Each of the top sections 101 and each of the bottom sections 102 is engaged with two plates 104.

As illustrated in FIG. 7, the joints in adjoining lengths of the top section 101, the bottom section 102, and the plates 104 may occur in different locations. Specifically, adjoining lengths are joined at seams 109A, 109B. The top section 101 is joined by a top seam 109A. The visibly joined plates 104 are joined at plate seams 109B. The bottom section 102 is one continuous element in FIG. 7. Offsetting the seams 109 prevents the seam from being a weak point in the controlled environment system. Prior art ceiling grid beams 22 were monolithic in construction. Two prior art ceiling grid beams 22 as illustrated in FIG. 1, could not be joined end to end without having a seam for the full prior art ceiling grid beam 22 in one location, creating a structural weak point in the prior art ceiling grid construction.

The proposed designs provide a modularity of installation element to adjust for field conditions and alternate insulated metal panels. Obstructions presented when fitting controlled environment spaces into pre-existing structures can be built around with reduced field alteration, if any, of building elements. Reducing or eliminating the need to alter building elements of controlled environments increases the reliability of the controlled environment, while also reducing labor associated with onsite modifications.

An alternative use for the grid beam assembly would be to operate as a catwalk assembly. Rather than supporting a ceiling, the grid beam assemblies (100) would support the floor of a catwalk with optional walls on either side of the catwalk for hanging from girders (12). The catwalk would include at least two ceiling grid assemblies (100) secured in a side-by-side configuration, the ceiling grid assemblies each comprising a top section (101), each top section comprising at least one plate channel (103) facing a plate channel of another ceiling grid assembly. At least one plate (104) configured to be snugly fit into and attached to at least one of the plate channels (103) and is disposed in facing plate channels (103) joins adjacent ceiling grid assemblies in a side-by-side configuration. At least two threaded connectors (20) secure a respective top section. At least two threaded rods (18) threadedly engage on a first end to a respective threaded connector and secure on a second end to a girder (12).

The plate channels (103) of the catwalk assembly could include beveled plate channel ends (105) to ease insertion of the plates (104).

Figure 8:
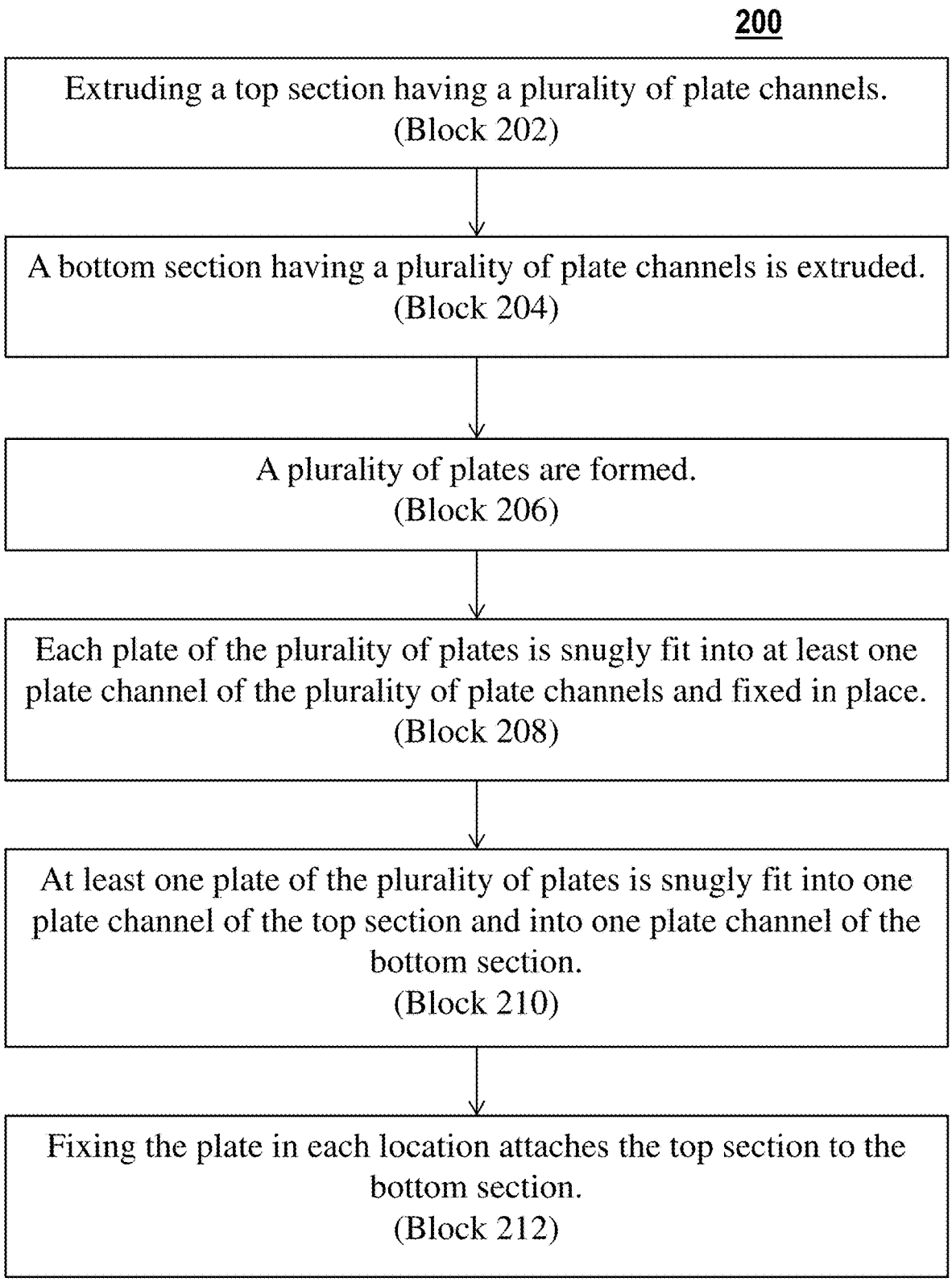
FIG. 8 is a flow chart illustrating a method of forming elements of a controlled environment hung ceiling in accordance with the first exemplary embodiment of the present disclosure.

FIG. 8 is a flow chart 200 illustrating a method of forming elements of a controlled environment hung ceiling in accordance with the first exemplary embodiment of the present disclosure. The flow chart 200 includes extruding a top section 101 having a plurality of plate channels 103A-D (block 202). A bottom section 102 having a plurality of plate channels 103E-H is extruded (block 204). A plurality of plates 104 are formed (block 206). Each plate 104 of the plurality of plates 104 is snugly fit into at least one plate channel 103A-H of the plurality of plate channels 103A-H and fixed in place (block 208). At least one plate 104 of the plurality of plates 104 is snugly fit into one plate channel 103A-D of the top section 101 and into one plate channel 103E-H of the bottom section 102 (block 210). Fixing the plate 104 in each location attaches the top section 101 to the bottom section 102 (block 212).

Figure 9:
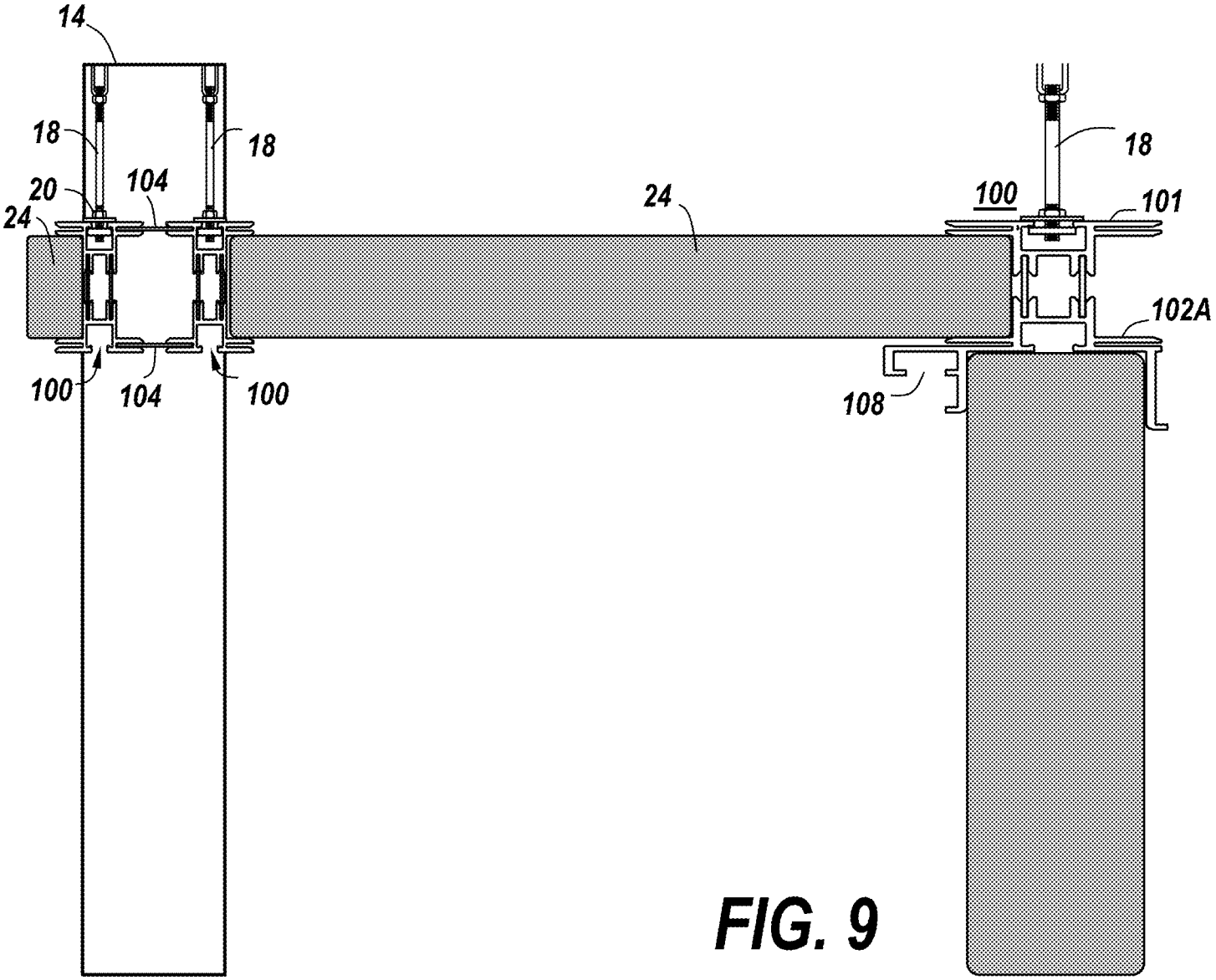
FIG. 9 is an illustration of a cross-sectional view of a room in accordance with the first exemplary embodiment of the present disclosure.

FIG. 9 is an illustration of a cross-sectional view of a room in accordance with the first exemplary embodiment of the present disclosure. As can be easily appreciated, the room is constructed from elements introduced in relations to FIGS. 3-7. The room may include walls and a ceiling formed from insulated panels 24. Each ceiling grid beam 100 includes a top section 101 and a bottom section 102. The top section 101 and the bottom section 102. Plates 104 are installed between the adjoining top sections 101 and bottom sections 102, between two adjoining top sections 101, and between two adjoining bottom sections 102. Each of the top sections 101 and each of the bottom sections 102 is engaged with multiple plates 104.

The column 14 is included and the relationship of the column 14 relative to the ceiling grid beams 100 can be compared to the prior art system in FIG. 2. Specifically, the second face 14B of the column 14 is coplanar with a surface of one of the top section 101 and the bottom section 102. This relationship allows an insulated panel 24 to be inserted into that space and abut interior surfaces of the top section 101 and the bottom section 102 and the second face 14B of the column 14, obviating the need to cut or reshape the insulated panel to fit the column 14. Placing two ceiling grid beams 100 in close proximity and joining the ceiling grid beams 100 with two plates 104 allows insulated panels 24 to be placed abutting the column 14 on the second face 14B and an opposite face of the column 14, which was not achievable with any previously known design.

Figure 10:
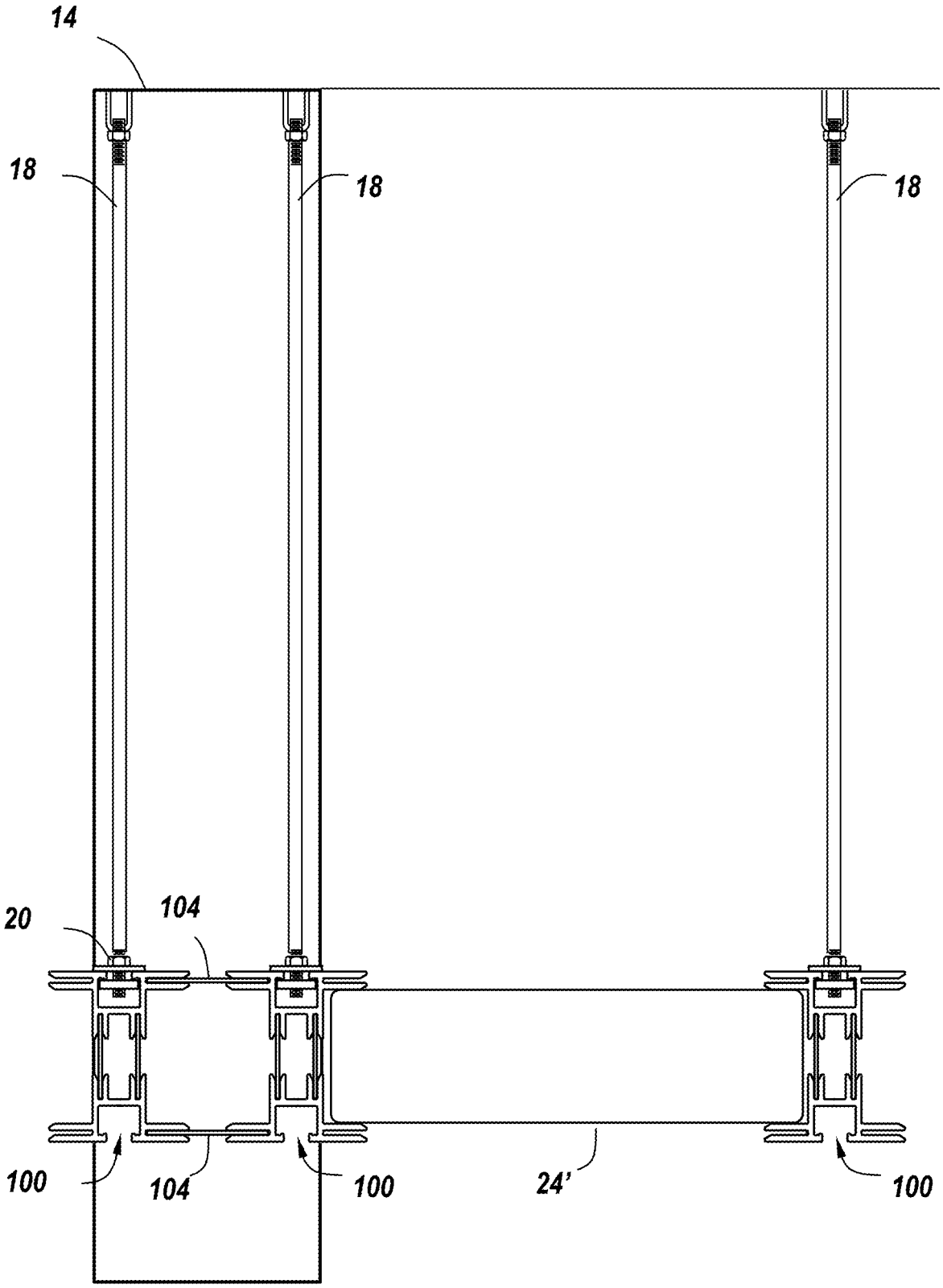
FIG. 10 is an illustration of a cross-sectional view of a catwalk in accordance with the first exemplary embodiment of the present disclosure.

FIG. 10 is an illustration of a cross-sectional view of a catwalk in accordance with the first exemplary embodiment of the present disclosure. The threaded rods 18 are connected by connectors 20 to ceiling grid beams 100. The ceiling grid beams 100 abut the face of the column 14. Each ceiling grid beam 100 includes a top section 101 and a bottom section 102. The top section 101 and the bottom section 102 each include multiple plate channels 103A-H (not labeled). The plate channels 103A-H provide for the installation of plates 104 between the adjoining top sections 101 and bottom sections 102, between two adjoining top sections 101, and between two adjoining bottom sections 102. The catwalk panel 24' is installed horizontally between coplanar ceiling grid beams 100.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description. Future-filed applications claiming priority to this application may claim the disclosed subject matter in a different manner and generally may include any set of one or more limitations as variously disclosed or otherwise demonstrated herein.

The invention claimed is:

1. A ceiling grid beam assembly comprising:

a top section, the top section comprising a first plurality of plate channels;

a bottom section, the bottom section comprising a second plurality of plate channels; and a plurality of plates, wherein each plate of the plurality of plates is snugly fit into and attached to at least one of the plate channels and at least one of the plurality of plates is attached to both the top section and the bottom section; and wherein each plate channel of the first and second plurality of plate channels are defined by substantially parallel plate channel members.

2. The ceiling grid beam assembly of claim 1, wherein the top section and the bottom section have the same profile, and each of the top section and the bottom section is symmetrical about a vertical axis.

3. The ceiling grid beam assembly of claim 1, wherein the top section plate channels comprise two horizontal co-planar plate channels and two vertical parallel plate channels.

4. The ceiling grid beam assembly of claim 3, wherein the bottom section plate channels comprise two horizontal co-planar plate channels and two vertical parallel plate channels.

5. The ceiling grid beam assembly of claim 4, wherein a size of the at least one of the plurality of plates attached to both the top section and the bottom section is selected to set a height between the top section horizontal plate channels and the bottom section horizontal plate channels sufficient to receive an insulated panel therebetween.

6. The ceiling grid beam assembly of claim 1, wherein the first and second plurality of plate channels comprise beveled plate channel ends configured to ease insertion of at least one of the plurality of plates.

7. The ceiling grid beam assembly of claim 1 further comprising adhesives or mechanical fasteners, the plates fixed to the plate channels by the adhesives or mechanical fasteners.

8. The ceiling grid beam assembly of claim 1, the bottom section further comprising a vertical panel channel and a C-channel configured to support construction elements beneath the ceiling grid beam assembly.

9. The ceiling grid beam assembly of claim 1, the top section comprising a plurality of top sections disposed end-to-end and separated by a top seam, the plurality of plates comprising a plurality of plates disposed end-to-end and separated by a plate seam, the top seam offset from the plate seam, thereby strengthening the assembly and preventing a structural weak point.

10. A controlled environment hung ceiling assembly comprising:

at least two ceiling grid assemblies secured in a side-by-side configuration, the ceiling grid assemblies each comprising:

a top section, the top section comprising a first plurality of plate channels;

a bottom section, the bottom section comprising a second plurality of plate channels; and a plurality of plates, wherein each plate of the plurality of plates is snugly fit into and attached to at least one of the plate channels, wherein at least one of the plurality of plates is attached to both the top section and the bottom section;

at least one plate of the plurality of plates is disposed in facing plate channels thereby joining adjacent ceiling grid assemblies in a side-by-side configuration;

at least two threaded connectors configured to be secured to a respective top section; and at least two threaded rods configured to be threadedly engaged on a first end to a respective threaded connector and configured to be secured on a second end to a girder.

11. The controlled environment hung ceiling assembly of claim 10, further comprising a metal channel configured to be secured to the girder, the threaded rods thereby configured to be secured to the girder via the metal channel.

12. The controlled environment hung ceiling assembly of claim 10, wherein each top section plate channels comprise two horizontal co-planar plate channels and two vertical parallel plate channels, wherein each bottom section plate channels comprise two horizontal co-planar plate channels and two vertical parallel plate channels.

13. The controlled environment hung ceiling assembly of claim 12, wherein a size of the at least one of the plurality of plates attached to both the top section and the bottom section is selected to set a height between top section horizontal plate channels and bottom section horizontal plate channels sufficient to receive an insulated panel therebetween.

14. The controlled environment hung ceiling assembly of claim 13, wherein a size of the at least one plate of the plurality of plates disposed in facing plate channels is selected so that respective insulated panels received between the top section horizontal plate channels and the bottom section horizontal plate channels of the side-by-side ceiling grid assemblies have edges that abut opposite second sides of a column supporting the girder, thereby obviating a need to cut or reshape the insulated panels to fit the column.

15. The controlled environment hung ceiling assembly of claim 14, wherein respective ends of the at least two ceiling grid assemblies secured in a side-by-side configuration abut a first side of the column, the first side being adjacent and perpendicular to the second sides.

16. The controlled environment hung ceiling assembly of claim 10, wherein the top sections and the bottom sections have the same profile, and each of the top section and the bottom section is symmetrical about its vertical axis.

17. The controlled environment hung ceiling assembly of claim 10, the plate channels comprising beveled plate channel ends to ease insertion of the plates.

18. A catwalk assembly for hanging from girders comprising:

at least two grid assemblies secured in a side-by-side configuration, the grid assemblies each comprising a top section, each top section comprising at least one plate channel facing a plate channel of another ceiling grid assembly;

at least one plate configured to be snugly fit into and attached to at least one of the plate channels and is disposed in a facing plate channels thereby horizontally joining adjacent grid assemblies in a side-by-side configuration;

at least two threaded connectors configured to be secured to a respective top section; and at least two threaded rods configured to be threadedly engaged on a first end to a respective threaded connector and configured to be secured on a second end to a girder.

19. The catwalk assembly of claim 18, the plate channels comprising beveled plate channel ends to ease insertion of the plates.

20. A method of assembling a controlled environment ceiling framing apparatus, the method comprising:

extruding a top section having a first plurality of plate channels;

extruding a bottom section having a second plurality of plate channels;

forming a plurality of plates;

snugly fitting each plate of the plurality of plates into at least one plate channel of the plurality of plate channels and fixing each plate in place;

snugly fitting at least one plate of the plurality of plates into one plate channel of the plurality of plate channels of the top section and into one plate channel of the plurality of plate channels of the bottom section; and fixing the plate in each location thereby attaching the top section to the bottom section;

wherein each plate channel of the first and second plurality of plate channels are defined by substantially parallel plate channel members.

* * * * *